US006254454B1

(12) United States Patent
Easter et al.

(10) Patent No.: US 6,254,454 B1
(45) Date of Patent: Jul. 3, 2001

(54) REFERENCE THICKNESS ENDPOINT TECHNIQUES FOR POLISHING OPERATIONS

(75) Inventors: William Graham Easter; John Albert Maze, III; Frank Miceli, all of Orlando, FL (US)

(73) Assignee: Agere Systems Guardian Corp., Allentown, PA (US)

( * ) Notice: Subject to any disclaimer, the term of this patent is extended or adjusted under 35 U.S.C. 154(b) by 0 days.

(21) Appl. No.: 09/426,017

(22) Filed: Oct. 25, 1999

(51) Int. Cl.[7] ..... B24B 49/00

(52) U.S. Cl. ..... 451/8; 451/9; 451/10; 451/41

(58) Field of Search ..... 451/8, 9, 10, 11, 451/41, 285, 287

(56) References Cited

U.S. PATENT DOCUMENTS 5,486,129 * 1/1996 Sandhu et al. .
5,667,629 * 9/1997 Pan et al. .
5,738,562 * 4/1998 Doan et al. .
6,007,405 * 12/1999 Mei .

* cited by examiner

*Primary Examiner*—Joseph J. Hail, III
*Assistant Examiner*—Willie Berry, Jr.
(74) *Attorney, Agent, or Firm*—Christie, Parker & Hale, LLP

(57) ABSTRACT

A method and system for determining endpoint in a chemical mechanical polishing operation by measuring the amount of linear displacement of a member such as an assembly which secures the substrate being polished and urges the surface being polished towards the rotating polishing pad. The thickness of material being removed corresponds to the amount of linear displacement, and endpoint is achieved and therefore detected when a desired material thickness has been removed. The linear displacement can be measured using various techniques such as by using a dial gauge, laser or profilometer.

19 Claims, 2 Drawing Sheets

REFERENCE THICKNESS ENDPOINT TECHNIQUES FOR POLISHING OPERATIONS

FIELD OF THE INVENTION

The present invention relates generally to chemical mechanical polishing of substrates, and more particularly to the detection of a polishing endpoint by determining the thickness of the material being removed by polishing.

BACKGROUND OF THE INVENTION

Chemical mechanical polishing (CMP) is one method of providing a planarized substrate surface. Such substrates may be used in the manufacture of integrated circuit devices, for example. CMP may be used to planarize raw substrates, to completely or partially remove a bulk deposited layer, or to planarize a surface by partially removing layers which have been deposited over a non-planar feature formed on a substrate. For each of the above operations, it is critical to detect when a desired amount of material has been removed. Once this "endpoint" condition has been attained, the polishing operation may be terminated, or it may be adjusted to proceed to another polishing operation having different polishing characteristics.

A typical CMP apparatus employs a rotating polishing surface, such as a consumable polishing pad, against which the surface of the substrate being polished, is placed. The CMP apparatus also includes a carrier which secures the substrate in a desired position with respect to the pad. The carrier includes means for providing a force to keep the substrate in contact with the pad, and also may include means for rotating, vibrating, or oscillating the substrate. Most commonly, the carrier is centrally connected to a spindle which rotates the carrier and substrate being polished, and provides the force which urges the substrate being polished, towards the polishing pad. During polishing, a slurry having both chemical and abrasive agents may be supplied to the interface between the substrate and the pad to enhance the rate at which material is removed from the substrate.

One problem associated with CMP is endpoint detection. Endpoint may be defined as the point at which the desired polishing process is completed. When "endpoint" is attained, a number of different actions may be taken in response. For example, the entire polishing process may be terminated when endpoint is attained or the polishing conditions may be changed as the polishing process continues, with another polishing operation, to polish an underlying material. For example, the process conditions may be changed to produce a final buffing operation, or they may be changed to produce another polishing operation having different characteristics to polish an underlying film. It can be seen that a substrate containing a stack of films to be polished, may include a number of discrete polishing operations, each of which includes an associated "endpoint."

Depending on the chemical mechanical polishing operation being performed, "endpoint" may signify different events. For example, when polishing a raw substrate, "endpoint" may be achieved when a certain predetermined substrate thickness has been removed. The same is true for a layer or film which is being partially removed. When a film is being completely removed from a substrate, "endpoint" is attained upon complete removal of the film. When CMP is used to planarize a substrate by removing portions of a film which extend above underlying features, "endpoint" is achieved when the surface is essentially planar. Generally speaking, "endpoint" is achieved after a predictable amount of material is removed from the surface. It is therefore necessary to accurately detect when a prescribed amount of material has been removed from the surface being polished. Once the prescribed material thickness has been removed, the polishing operation may be quickly terminated or otherwise adjusted, at that point. Because the substrate is polished face-down and the polishing surface is generally contiguous with the polishing pad, a process monitor cannot easily be used to continuously monitor the surface being polished. As such, it is difficult to attempt to use such a monitor to determine the polishing "endpoint." Optical or spectral means are generally not available as endpoint detectors which continuously monitor the surface being polished.

Variations in the polishing conditions also impede an accurate determination of the polishing endpoint. For example, variations in the slurry flow is rate and composition, pad condition, relative speed between the pad and the substrate, the material being polished, and the load of the substrate on the pad, may cause variations in the material removal rate. These variations in the material removal rate cause variations in the time needed to reach the polishing endpoint. Therefore, the polishing endpoint cannot reliably be estimated merely as a function of polishing time.

One approach to predicting the polishing endpoint is to periodically remove the substrate from the polishing surface and measure the thickness of the substrate or the film being removed by polishing. By periodically removing the substrate from the polishing surface and measuring its thickness, the rate of material being removed from the substrate may be determined. As such, a linear approximation of the material removal rate may be used to determine the polishing endpoint. This method is time consuming, requires repeatedly removing the substrate from the polishing operation, and does not account for sudden changes in the removal rate that may occur between measurement intervals. Moreover, this method does not account for the other variations in the material removal rate, as discussed above.

Several other non-invasive methods of endpoint detection are known. These methods generally fall into two categories: those which require access to the surface of the substrate being polished, and those which determine the polishing endpoint by determining changes in the operation of the polishing apparatus.

Methods included within the first category typically require real-time access to at least a portion of the substrate surface being polished, such as by sliding a portion of the substrate over the edge of the polishing pad and simultaneously analyzing the exposed portion of the substrate. For example, where polishing is used to remove the bulk of a conductive film such as a metal, and to expose a subjacent dielectric layer, the overall or composite reflectivity of the surface being polished changes as the bulk metal film is removed and the dielectric layer is exposed. By monitoring the reflectivity of the polished surface or the wavelength of light reflected from the surface, the polishing endpoint can be detected as the reflectivity changes when the dielectric layer is exposed. However, this method is limited to determining the polishing endpoint when a first film is being completely removed from over a second material which has a reflectivity which varies from the first film being polished. Additionally, it is somewhat erratic in predicting the polishing endpoint unless all of the underlying surface of a different reflectivity, is simultaneously exposed. Furthermore, the detection apparatus is delicate and subject to frequent breakdown caused by the exposure of the measuring or detecting apparatus to the slurry.

Methods for determining the polishing endpoint included within the second category, do so by monitoring various parameters of the polishing apparatus and indicating that endpoint has been attained when one or more of the parameters abruptly changes. An example of such a parameter is the coefficient of friction at the interface of the polishing and the substrate. When a metal layer is being polished to expose an underlying dielectric layer, the coefficient of friction will change when the dielectric layer is exposed. As the coefficient of friction changes, the torque necessary to provide the desired polishing pad speed also changes. By monitoring this change such as by monitoring the polishing motor current, endpoint may be detected. However, the coefficient of friction is a function of the slurry composition, the pad condition, the load of the substrate on the pad, and the surface condition of the substrate, and, as the substrate is being polished, the pad condition and the slurry composition at the pad-substrate interface, change. Moreover, vibration and electrical noise may distort the characteristic being measured. Such effects may mask the change in the characteristic being monitored and may endpoint the polishing operation at the incorrect time. Additionally, this method of endpoint detection will only work if the polishing operation is used to expose an underlying material having a frictional attribute different than that of the material being removed.

Another method for determining endpoint included within the second category involves monitoring the current supplied to each of the polishing motors, and determining that endpoint has been achieved when a predetermined amperage sum has been reached. Like the other methods included within the second category, this method can also be adversely influenced by the above effects.

It can be seen that none of the available endpointing methods described above, detect endpoint by directly monitoring the amount of material being removed from the surface being polished, without interrupting the polishing process. As such, none of the known methods for determining endpoint, do so by measuring the amount of material being removed, or by measuring the corresponding thickness loss of the substrate being polished, during the actual polishing operation. It can be understood, then, that such a method is desirable in the art of CMP.

It can be further seen that there is a need to provide a method for detecting endpoint when a prescribed amount of material has been removed from a substrate in order to terminate or otherwise adjust the polishing process at this point.

SUMMARY OF THE INVENTION

The present invention relates to an endpoint detection system and method for use in conjunction with a polishing operation such as a chemical mechanical polishing operation. The endpoint detection method includes monitoring the linear displacement of a member which urges the substrate being polished, towards the polishing pad. When a prescribed amount of linear displacement has occurred, signifying that a corresponding prescribed amount of thickness has been removed from the substrate being polished, the endpoint condition is detected. The method of the present invention may be used to determine endpoint when polishing any of various films formed on the substrate, or when polishing the substrate itself. When the endpoint condition is detected, the polishing operation may be terminated or otherwise adjusted. The linear displacement may be monitored using a laser or other interferometer, a dial gauge, a profilometer, or other means which may be coupled to electronic circuitry for determining the endpoint condition.

DETAILED DESCRIPTION OF THE INVENTION

The present invention is directed to a method and apparatus for determining the point at which an endpoint condition is attained during a polishing operation. More particularly, the method of the present invention is directed to measuring an amount of linear displacement of the assembly which retains the substrate and urges the substrate towards a polishing pad surface within a polishing apparatus such as a chemical mechanical polishing apparatus. The assembly includes the substrate being polished, the carrier which secures the substrate in a desired position with respect to the polishing pad, and a shaft which is connected to the carrier. In an exemplary embodiment, the shaft may be a spindle which rotates thereby rotating the carrier and the substrate. A force is applied along a direction which is generally perpendicular to the interface formed of the substrate surface being polished and the polishing pad. The force so applied, urges the assembly along a first direction such that the surface being polished is forced against the polishing pad which rotates thereby polishing the surface. The first direction will be perpendicular to the substrate surface-pad surface interface in the preferred embodiment. The applied force provides for linear displacement of the assembly along the first direction. The linear displacement of the assembly is equal to the amount of thickness of material being removed from the substrate being polished, since the polishing pad essentially remains in constant position with respect to the first direction. The present invention is directed to monitoring this linear displacement in order to determine when a desired thickness of material has been removed from a substrate.

Figure 1:
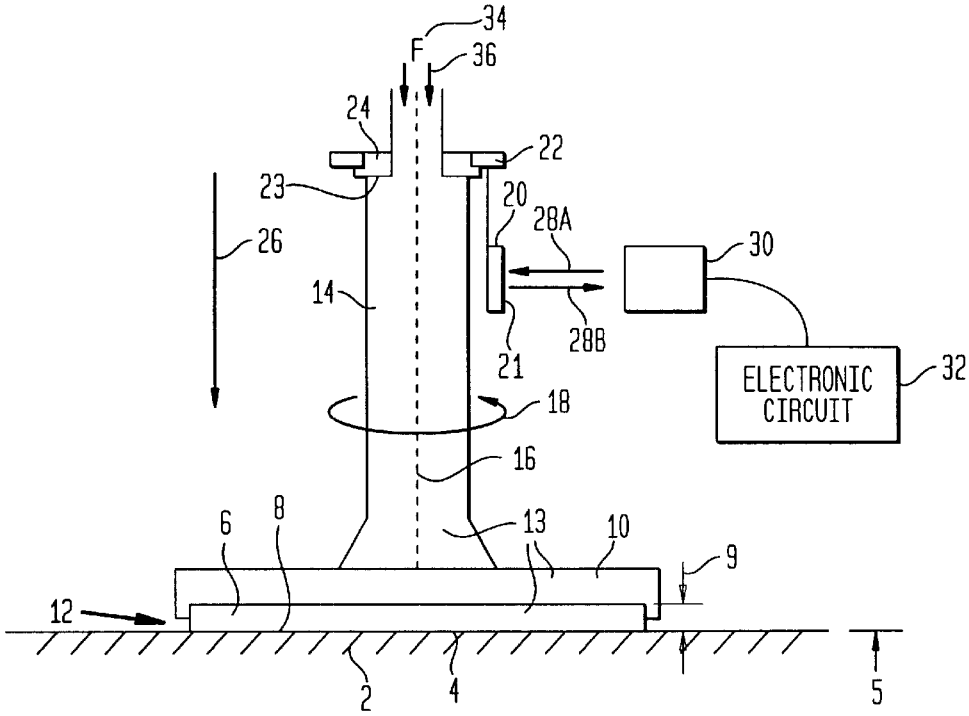
FIG. 1 is a cross-sectional side view of a CMP apparatus showing an exemplary embodiment of the endpoint detector of the present invention.

FIG. 1 is a cross-sectional side view showing a substrate being polished within a portion of a CMP apparatus. FIG. 1 includes a polishing pad 2 which includes pad surface 4. Polishing pad 2 may be a gradually consumable polishing pad having a rough pad surface 4 which polishes the substrate. Substrate 6 includes substrate surface 8 which is being polished. Substrate 6 may be a semiconductor substrate such as a silicon wafer commonly used in the semiconductor manufacturing industry, or any other substrate suited for polishing. In an exemplary embodiment, substrate 6 may include integrated circuit devices partially formed thereon. Interface 12 is formed between substrate surface 8 and pad surface 4. Thickness 9 represents the overall thickness of the substrate being polished. Thickness 9 may include simply the thickness of the raw substrate, or it may include a raw substrate and a separately formed film or films added to the substrate. In an exemplary embodiment, the polishing operation may be used to polish a substrate including a film formed on a semiconductor wafer. At any rate, thickness 9 includes the overall thickness of the substrate being polished, including any films included on the raw substrate. As a substrate is polished, material is removed from substrate surface 8 by polishing and overall thickness 9 of the substrate is diminished. Substrate 6 is secured by carrier 10. Substrate 6 does not move with respect to carrier 10. Carrier 10 is centrally attached to shaft 14. Shaft 14 may be a rotatable spindle which rotates about axis 16 of shaft 14. The direction of rotation may be counterclockwise as shown by arrow 18, or it may be clockwise. When shaft 14 rotates, carrier 10 may be fixedly attached to shaft 14 and may therefore rotate along with shaft 14. In this exemplary embodiment, substrate 6 also rotates together with carrier 10. In another exemplary embodiment, the rotation of shaft 14 about its axis 16 may not impart rotational motion upon carrier 10 or substrate 6.

The mechanical aspect of chemical mechanical polishing is provided by at least the following two factors: i) Polishing pad 2 includes translational motion along the plane formed by the interface 12 between substrate surface 8 and pad surface 4. In the preferred embodiment, polishing pad 2 rotates about an axis other than axis 16 of shaft 14. ii) While pad 2 moves with respect to assembly 13 which includes shaft 14, carrier 10, and substrate 6, a force F is applied along direction 36 to urge the assembly 13 along direction 26. In the preferred embodiment, both direction 36 and direction 26 will be perpendicular to substrate surface 8. Force F may be applied using any conventional mechanical means as suitable in the art. The force exerted along direction 36 causes substrate surface 8 down towards rotating, rough pad surface 4, thereby enabling the removal of material from substrate surface 6 by means of CMP. In other exemplary embodiments, the mechanical aspect of chemical mechanical polishing may be aided by abrasives included within a polishing slurry (not shown) which may be introduced to interface 12. In another exemplary embodiment, the mechanical aspect may be further aided by the rotation of shaft 14, carrier 10, and substrate 6, about axis 16.

Conventional means are used to assure that polishing pad 2 does not move with respect to direction 26. It can be seen that the amount of linear displacement of carrier 13 along direction 26 is directly equal to the amount by which overall substrate thickness 9 is reduced during the polishing operation.

The present invention is directed to monitoring an amount of linear displacement of assembly 13 along direction 26. In this manner, the amount by which substrate thickness 9 is reduced during polishing, is determined. When substrate thickness 9 has been reduced by a prescribed amount, an endpoint condition is attained with respect to the polishing operation being carried out. The amount by which assembly 13 is linearly displaced along direction 26 can be ascertained by first baselining the operation by determining the position of carrier 13 with respect to direction 26, at the initiation of the polishing operation being monitored. This baselining operation is necessary because, in time, position 5 of pad surface 4 may change with respect to direction 26 as the polishing pad surface is consumed. This is a slow process, however, and position 5 does not change appreciably during a single polishing operation. Most of the consumption of pad material occurs during the pad conditioning operation. Therefore, it can be seen that, by baselining the initial position of assembly 13 along direction 26, then continuously or periodically measuring the position of assembly 13 along direction 26, the amount of linear displacement (of assembly 13) during the polishing operation, may be ascertained. Since it can be assumed that the position 5 of pad surface 4 does not change appreciably during a particular polishing operation, it can be seen that the amount of linear displacement of assembly 13 along direction 26, is essentially equal to the thickness 9 loss of substrate 6 effected by polishing. The present invention includes various exemplary embodiments for determining the amount of linear displacement of carrier 13 along direction 26.

In FIG. 1, positioning unit 20 is coupled to shaft 14 in such a way that positioning unit 20 travels concurrently with assembly 13 along direction 26, but does not rotate along with the shaft in embodiments where the shaft does indeed rotate. This may be accomplished by coupling positioning unit 20 to shaft 14 by means of coupling means 22 which may be separated from the shaft 14 by means of spacer 24. In an exemplary embodiment, spacer 24 may be a lubricated washer or other means for allowing positioning unit 20 to travel along direction 26 concurrently with shaft 14 without rotating with the shaft. In an exemplary embodiment, spacer 24 may rest partially on ledge 23 of shaft 14. In alternative embodiments, other coupling means may be used. Additional retaining means (not shown) may be added to prevent positioning unit 20 from rotating. It should be understood that portioning unit 20 is not intended to be limited to the configuration shown in FIG. 1. In other exemplary embodiments, the positioning unit may take on other shapes. For example, it may extend peripherally around shaft 14.

The position of positioning unit 20 along direction 26 may be read by measuring unit 30. Measuring unit 30 may be an interferometer such as one that uses a laser, or other optical means, to produce beam 28*a* directed from measuring means 30 towards positioning unit 20, and which can analyze reflected beam 28*b* which is reflected by positioning unit 20 back to measuring unit 30. Measuring unit 30 will include means for determining the position of positioning unit 20 (and therefore assembly 13) along direction 26. Surface 21 of positioning unit 20 may be chosen for compatibility with measuring unit 30 and the optical beams 28*a*, 28*b* used to determine position. In an exemplary embodiment, surface 21 may include a plurality of strips (not shown) arranged perpendicular to direction 26 of linear displacement. In an exemplary embodiment, the strips may be arranged perpendicular to the direction of displacement and side-by-side, with adjacent strips having different optical properties. Electronic circuit 32 is coupled to measuring unit 30 and may be used to analyze the measurement data obtained by measuring unit 30. The analyzed data may be displayed, or an electronic signal may be developed from the analyzed data.

Figure 2:
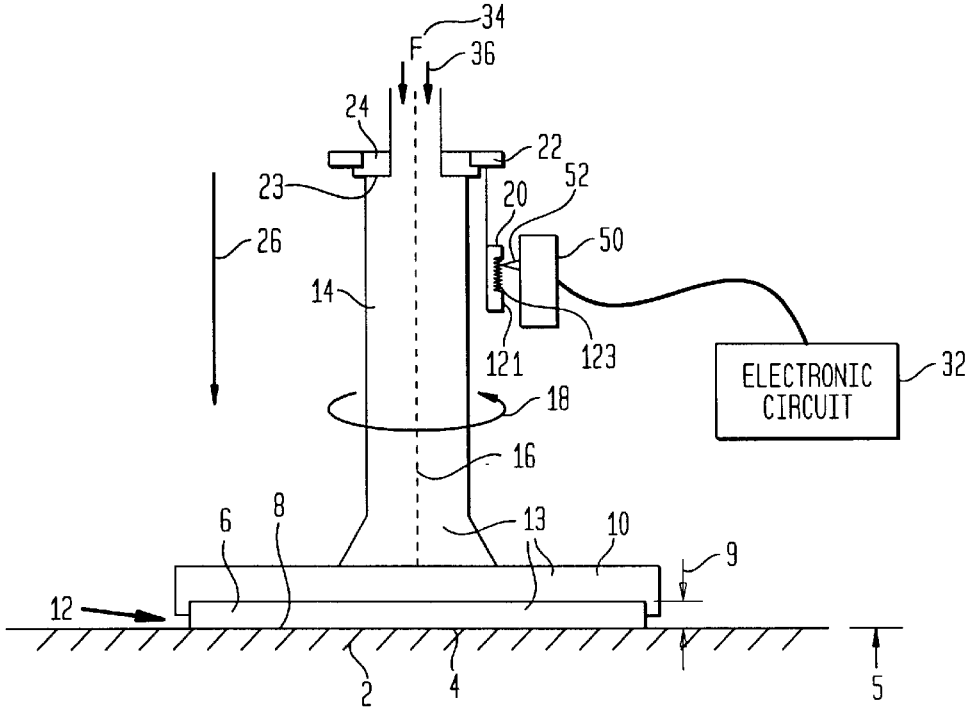
FIG. 2 is a cross-sectional side view of a CMP apparatus showing a second exemplary embodiment of the endpoint detector of the present invention.

Now turning to FIG. 2, the apparatus is as described in conjunction with FIG. 1, with the exception being that profilometer 50 is used to measure the position of positioning unit 20. In this exemplary embodiment, positioning unit 20 includes a series of ridges 123 formed on surface 121. The ridges extend along a direction perpendicular to direction 26 of linear displacement. Profilometer 50 includes stylus 52 which resiliently contacts surface 121. Stylus 52 remains fixed with respect to direction 26. As such, when assembly 13 and positioning unit 20 move concurrently along direction 26 of linear displacement, profilometer 50 can determine the amount of linear displacement along direction 26 by counting the number of ridges 123 which stylus 52 traverses.

Figure 3:
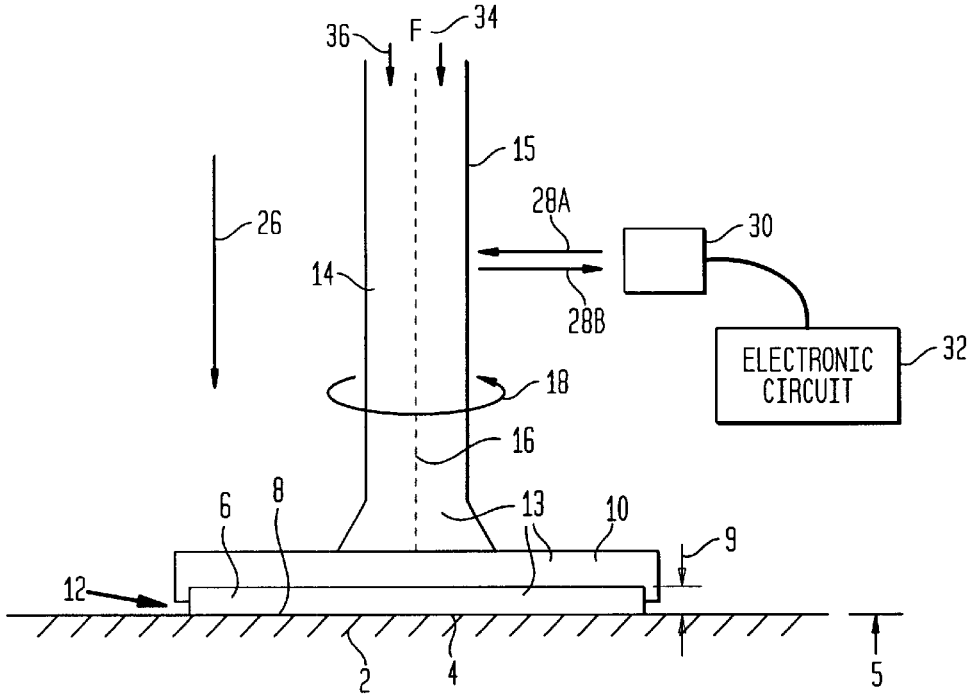
FIG. 3 is a cross-sectional side view of a CMP apparatus showing a third exemplary embodiment of the endpoint detector of the present invention.

FIG. 3 shows another aspect of the present invention. In FIG. 3, where similarly numbered features are as in described in conjunction with FIG. 1, positioning unit 20 is not needed. In the exemplary embodiment shown in FIG. 3, measurement unit 30 may use a laser or other optical means to provide a beam 28*a* directly onto surface 15 of shaft 14 and to read reflected beam 28*b* from surface 15. In various exemplary embodiments, different means may be used whereby measuring unit 30 can determine the position, and thereby the displacement, of assembly 13 along direction 26. Surface 15 may include markings or ridges (not shown) for use in conjunction with measurement unit 30. Examples of such markings or ridges include the ridges and strips described in conjunction with the positioning units shown in FIGS. 1 and 2. In one exemplary embodiment, shaft 14 may not be rotating about its axis, while in another exemplary embodiment, shaft 14 may rotate about axis 16. Measuring unit 30 may be adapted to detect linear displacement along direction 26 for any of the above exemplary embodiments.

Figure 4:
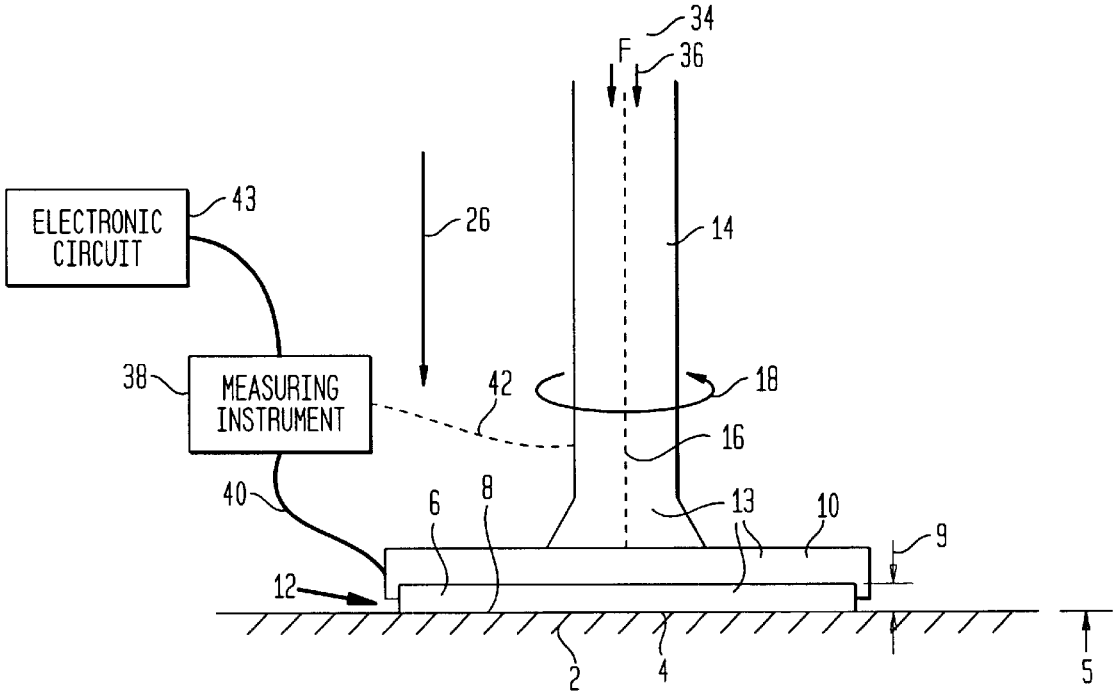
FIG. 4 is a cross-sectional side view of a CMP apparatus showing fourth and fifth exemplary embodiments of the endpoint detector as in the present invention.

FIG. 4 shows another exemplary embodiment of a sensor used to detect linear displacement of assembly 13 along direction 26. In FIG. 4, where similarly numbered features are as in described in conjunction with FIG. 1, measurement instrument 38 may be coupled to assembly 13. In one exemplary embodiment, measurement instrument 38 may be coupled by coupling means 40 to carrier 10. In another exemplary embodiment, measurement instrument 38 may be coupled by coupling means 42 to shaft 14. In each exemplary embodiment, measurement instrument 38 may be directly coupled by means of coupling means 40 or 42, or may be coupled to an intermediate unit (not shown) depending on the particular measurement instrument 38 which may be used. Any suitable conventional means for coupling a measurement instrument to assembly 13 in such a manner so as to provide for measurement instrument 38 to measure the linear displacement of assembly 13 along direction 26, may be used. In a preferred embodiment, measurement instrument 38 may be a dial gauge.

Measurement unit 38 is adapted to read linear displacement of assembly 13 along direction 26. In an exemplary embodiment, measurement instrument 38 may be additionally coupled to a fixed member (not shown) which does not move with respect to direction 26. In this exemplary embodiment, measurement instrument 38 may measure a distance between the fixed member and a position on assembly 13 which moves along direction 26. The fixed member (not shown) may be located above or below assembly 13 within the CMP apparatus.

As in the previous exemplary embodiments, electronic circuit 43 may be used to analyze measurement data obtained by measurement instrument 38, and to provide a signal or other electrical, graphical, or digital display, indicating the amount of linear displacement along direction 26.

Together with the baseline data indicating the position of carrier 13 with respect to direction 26 at the initiation of the polishing operation, the position of assembly 13 as determined by any of the exemplary measurement units described above, may be used to provide the amount of linear displacement of assembly 13 along direction 26. The amount of linear displacement is substantially equal to the amount by which thickness 9 of substrate 6 is reduced. When the desired amount of substrate thickness 9 has been removed by polishing, endpoint is attained and the operation may be terminated or otherwise adjusted. In an exemplary embodiment, the adjustment may include changing some or all of the system parameters or settings so as to change the polishing conditions. In this manner, the polishing process may be continued with another polishing operation directed to polishing the newly exposed underlying film or films. In an exemplary embodiment, the adjustment may be used to change the polishing operation so as to provide a buffing operation which is used to buff or smooth the substrate surface without appreciably diminishing substrate thickness.

It can be seen that the present invention is not limited to polishing a particular type of film. Rather, an advantage of the present invention is that it may be used to determine polishing endpoint by detecting the amount by which a thickness of a raw substrate, or of any film or stack of films, has been reduced.

For each of the above embodiments, any suitable conventional electronic circuitry may be used to analyze and process the measurement data, and to display the measured value of thickness loss, either graphically, electrically, or digitally. An endpoint condition is indicated when a prescribed amount of substrate thickness has been removed. A reaction is taken in response to the indication that an endpoint condition has been attained. When endpoint is attained, the reaction taken to adjust the polishing operation may be a manual one, or it may include a further electrical circuit providing a real time, feed-forward signal to automatically adjust the polishing operation. Conventional electrical circuitry (not shown) available in the art may be used to provide a signal to the polishing apparatus in response to endpoint being detected.

The preceding description merely illustrates the principles of the invention. It will thus be appreciated that those skilled in the art will be able to devise various arrangements which, although not explicitly described or shown herein, embody the principles of the invention and are included within its spirit and scope. It should be understood that various other means and methods for determining the linear displacement of the assembly which is displaced to urge the surface being polished, towards the polishing pad, are contemplated. For example, a dial gauge, as described in conjunction with FIG. 4, may be used to detect the linear displacement of the positioning unit as described and shown in FIG. 1. As a further example, a profilometer, as shown and described in conjunction with FIG. 2, may be used to traverse surface features formed directly on the surface of the shaft and, as such, may not require a separate positioning unit to provide a readable surface.

All examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

As such, the invention is not intended to be limited to the details shown. Rather, various modifications and additions may be made in the details within the scope and range of equivalents of the claims and without departing from the invention.

What is claimed:

1. A method for removing a thickness of material from a substrate surface during a polishing operation, comprising the steps of:

(a) providing a polishing apparatus including a polishing pad having a pad surface and a substrate secured by a carrier adapted for urging said substrate along a first direction towards said pad surface, said first direction being generally perpendicular to said pad surface;

(b) polishing a substrate surface by (i) urging said substrate along said first direction and towards said pad surface, and (ii) generally maintaining contact between said substrate surface and said pad surface and providing translational motion therebetween, wherein said urging produces a displacement of said carrier along said first direction;

(c) monitoring an amount of said displacement which is substantially equal to a thickness by which said substrate is reduced; and (d) adjusting said polishing operation responsive to said amount of said displacement.

2. The method as in claim 1, wherein said step (d) comprises adjusting said polishing operation whereupon a prescribed amount of said displacement has been achieved.

3. The method as in claim 1, wherein step (d) comprises terminating said polishing whereupon a prescribed amount of said displacement has been achieved.

4. The method as in claim 1, wherein said step (d) comprises changing at least some characteristics of said polishing operation.

5. The method as in claim 1, wherein said step (d) comprises terminating said polishing operation when a prescribed amount of said displacement has been achieved and further comprises initiating a further polishing operation.

6. The method as in claim 1, wherein said substrate surface includes a film formed thereon and step (b) comprises polishing said film.

7. The method as in claim 1, in which said step (c) includes monitoring using a dial gauge.

8. The method as in claim 1, wherein said carrier includes a top section centrally attached to a rotatable shaft, step (b) includes rotating said shaft thereby rotating said carrier and said substrate, and said shaft is displaced concurrently with said carrier along said first direction.

9. The method as in claim 8, wherein said step (c) includes monitoring a position of said shaft with respect to said first direction.

10. The method as in claim 8, wherein said step (c) includes monitoring a distance between a location on said shaft and a further member, said further member being fixed with respect to said first direction.

11. The method as in claim 8, in further comprising the step of baselining said displacement by recording a position of said shaft along said first direction, upon initiation of said polishing.

12. The method as in claim 8, in which said step (c) includes directing a laser beam onto a surface of said shaft to detect said displacement of said shaft.

13. The method as in claim 1, wherein said carrier includes a top section attached to a shaft, said step (b) includes said shaft being concurrently displaced with said carrier along said first direction, and step (c) includes directing an optical beam onto a surface of said shaft, said surface including a plurality of strips formed thereon, said strips oriented perpendicular to said first direction and adjacent strips having different optical properties.

14. A method for removing a thickness of material from a substrate surface during a polishing operation, comprising the steps of:

(a) providing a polishing apparatus including a polishing pad having a pad surface and a substrate secured by a carrier adapted for urging said substrate along a first direction towards said pad surface, said carrier including a top section centrally attached to a rotatable shaft which includes a positioning unit coupled thereto;

(b) polishing a substrate surface by rotating said shaft thereby rotating said carrier and said substrate but not said positioning unit, (i) urging said substrate along said first direction and towards said pad surface, and (ii) generally maintaining contact between said substrate surface and said pad surface and providing translational motion therebetween, wherein said urging produces a concurrent displacement of said carrier, said shaft and said positioning unit along said first direction;

(c) monitoring an amount of said displacement by monitoring a position of said polishing unit; and (d) adjusting said polishing operation responsive to said amount of said displacement, wherein said amount of said displacement is substantially equal to a thickness by which said substrate is reduced.

15. The method as in claim 14, in which said positioning unit includes a plurality of ridges thereon, said ridges aligned substantially perpendicular to said first direction, and said step (c) includes monitoring said amount of displacement of said positioning unit using a profilometer.

16. The method as in claim 14, in which said step (c) includes monitoring by using a dial gauge coupled to said positioning unit.

17. The method as in claim 14, in which said step (c) includes directing a laser beam onto said positioning unit.

18. The method as in claim 14, in which said positioning unit includes a plurality of strips formed side-by-side on an exposed surface thereof, said strips aligned substantially perpendicular to said first direction and adjacent strips having different optical properties, and said step (c) includes directing an optical beam onto said exposed surface.

19. A method for removing a thickness of material from a substrate surface during a polishing operation, comprising the steps of:

(a) providing a polishing apparatus including a rotatable polishing pad having a pad surface and a substrate secured by a carrier having a top portion centrally attached to a rotatable shaft and adapted for urging said substrate along a first direction towards said pad surface;

(b) polishing a substrate surface by (i) urging said substrate along said first direction, and (ii) generally maintaining contact between said substrate surface and said pad surface while rotating said polishing pad and said shaft thereby rotating said substrate and providing translational motion between said substrate surface and said pad surface and wherein said urging produces a displacement of said substrate, said carrier and said shaft along said first direction;

(c) monitoring an amount of said displacement by using a profilometer to monitor a position of a positioning unit coupled to said shaft and being displaced concurrently with said shaft along said first direction, but not rotating therewith; and (d) changing at least some characteristics of said polishing operation whereupon a prescribed amount of said displacement has been achieved, wherein said amount of said displacement is substantially equal to an amount of thickness by which said substrate is reduced.

* * * * *